US005441214A

United States Patent [19]

Kushihashi et al.

[11] Patent Number: 5,441,214

[45] Date of Patent: Aug. 15, 1995

[54] PAPER WEB RESERVOIR APPARATUS

[75] Inventors: Shigenobu Kushihashi; Shigemitsu Inomata, both of Tokyo, Japan

[73] Assignee: Japan Tobacco Inc., Tokyo, Japan

[21] Appl. No.: 149,772

[22] Filed: Nov. 10, 1993

[30] Foreign Application Priority Data

Nov. 12, 1992 [JP] Japan ..... 4-301983

[51] Int. Cl.[6] ..... B65M 20/24

[52] U.S. Cl. ..... 242/552; 242/554; 226/118

[58] Field of Search ..... 242/551, 552, 554, 554.4; 226/118; 156/502, 504, 507

[56] References Cited

U.S. PATENT DOCUMENTS 3,993,233 11/1976 Bartell ..... 226/118
4,345,709 8/1982 Barton ..... 226/195
4,473,430 1/1984 Voltmer et al. ..... 242/58.1

FOREIGN PATENT DOCUMENTS 1315574 2/1961 France .
3605138 8/1986 Germany .
3936038 5/1991 Germany .
1086065 10/1967 United Kingdom .

*Primary Examiner*—John P. Darling

[57] ABSTRACT

A paper web reservoir apparatus comprises a reservoir box, which has an inlet port through which a paper web paid out from a paper web supply section is introduced into the reservoir box, an outlet port through which the paper web delivered to a cigarette rod forming machine, and a number of vent holes bored through the wall of the reservoir box.

11 Claims, 3 Drawing Sheets

PAPER WEB RESERVOIR APPARATUS

BACKGROUND OF THE INVENTION

1. Field of the Invention

The present invention relates to a paper web reservoir apparatus used for the manufacture of cigarettes, for example.

2. Description of the Related Art

A cigarette manufacturing machine comprises a wrapping section for forming cigarette rod. The wrapping section is continuously supplied with a paper web, which travels in one direction on the wrapping section. As the paper web is moved, cut tobacco, which is fed onto the paper web at the starting end of the wrapping section, is gradually wrapped in the web. When the paper web passes the wrapping section, therefore, a continuous cigarette rod is delivered from this section. Thereafter, the cigarette rod is cut into pieces or individual cigarettes with a predetermined length.

In order to improve the efficiency of cigarette production or the operating efficiency of the cigarette manufacturing machine, the cut tobacco and the paper web must be continuously supplied to the wrapping section for a long period of time.

To attain this, the cigarette manufacturing machine is provided with a supply section for continuously supplying the paper web. The supply section includes a pair of web rolls, and the paper web paid out from one of these rolls is supplied to the wrapping section. Thus, in this case, the one web roll serves as a working roll, and the other as a spare roll.

When the remaining paper web of the working roll runs short, the leading end of a spare paper web paid out from the spare roll is connected to the working web from the working roll, and the working web is cut on the upstream side of the junction between the two webs. From this time on, therefore, the spare web is paid out as a new working web from the spare roll, and is supplied to the wrapping section.

The delivery of the paper web from the working roll should be stopped during this web roll changing operation. In order to allow the cigarette manufacturing machine to be operated without interruption during the web roll changing operation, however, the paper web supply to the wrapping section must be continued even during the changing operation.

Accordingly, the cigarette manufacturing machine comprises a paper web reservoir apparatus which is located between the wrapping section and the supply section. The reservoir apparatus is stored with the paper web which has a greater length than is needed to cover the time required for the change of the web roll. Thus even when the delivery of the paper web from the supply section is stopped during the web roll changing operation, the operation of the cigarette manufacturing machine can be continued by supplying the paper web from the reservoir apparatus to the wrapping section.

In storing the paper web in the reservoir apparatus, the speed of delivery of the paper web from the working roll should be increased to a level higher than the traveling speed of the paper web passing the wrapping section, that is, line speed.

In recent years, there is a tendency for the line speed of modern cigarette manufacturing machines to be increased for higher productivity. Accordingly, the speed of introduction of the paper web to be stored in the reservoir apparatus is very high. As the paper web is introduced into the reservoir apparatus, therefore, a heavy vortex air current is produced in the apparatus. This air current may twist or cut the paper web. Such twisting or cutting of the paper web hinders steady supply of the web from the reservoir apparatus to the wrapping section, thus constituting a great cause of interruption of the operation of the cigarette manufacturing machine.

SUMMARY OF THE INVENTION

The object of the present invention is to provide a paper web reservoir apparatus, in which a paper web can be systematically stored prior to paper web changing operation, and can be steadily delivered toward a consuming unit.

The above object is achieved by a reservoir apparatus of the present invention, which comprises a reservoir box disposed between a paper web supply section and a consuming unit, the reservoir box having an inlet port and an outlet port for a paper web, and ventilation means for connecting the inside of the reservoir box to the ambient air.

According to the reservoir apparatus described above, part of an air current in the reservoir box is discharged through the ventilation means, or more specifically, through a number of vent holes, even though the paper web is introduced into the reservoir box to be stored therein through the inlet port at high speed. Accordingly, a vortex air current cannot be produced in the reservoir box. Thus, the paper web can be systematically stored in the reservoir box without being twisted or cut.

Preferably, the inlet port is formed in the top wall of the reservoir box, and a storage chamber is defined in the reservoir box so as to extend downward from the inlet port. Thus, the paper web introduced through the inlet port can be systematically stored in the storage chamber in a manner for folding the paper web.

Further, the reservoir apparatus may comprise feeding means for feeding the paper web, paid out from the supply section, into the storage chamber through the inlet port. More specifically, the feeding means includes a feed-in roller rotatably arranged in the vicinity of the inlet port at the outside of the reservoir box, and a pressure roller in rolling contact with the feed-in roller. The peripheral speed of the feed-in roller is increased as the paper web is stored in the reservoir box.

Preferably, the feeding means further includes detecting means for detecting the tension of the paper web passing in the reservoir box and outputting a detection signal responsive to the variation of the tension. In this case, the peripheral speed of the feed-in roller is adjusted in accordance with the detection signal from the detecting means, whereby the tension of the paper web can be kept constant.

BRIEF DESCRIPTION OF THE DRAWINGS

The present invention will become more fully understood from the detailed description given herein below and the accompanying drawings which are given by way of illustration only, and thus, are not limitative of the present invention, and wherein.

DETAILED DESCRIPTION OF THE PREFERRED EMBODIMENTS

Figure 1:
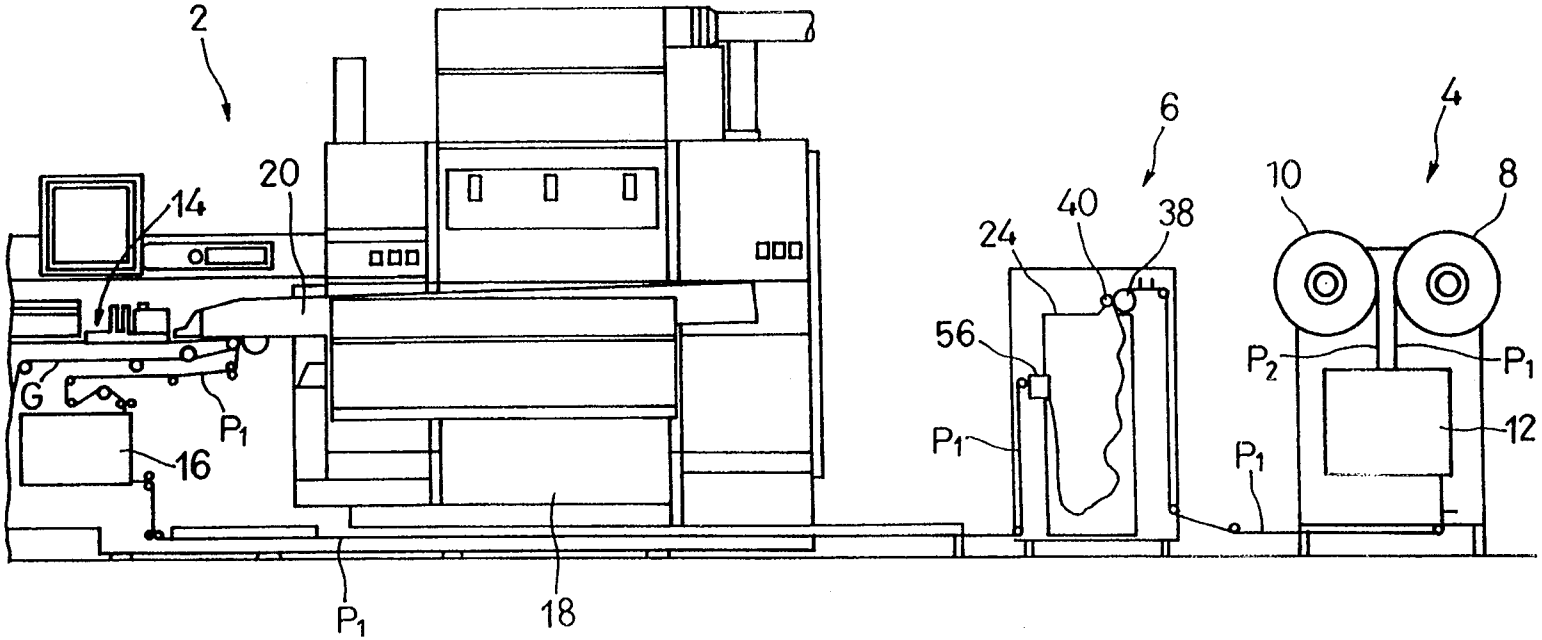
FIG. 1 is a schematic front view showing part of a cigarette manufacturing machine.

Referring to FIG. 1, there is shown a cigarette manufacturing machine, which comprises a cigarette rod forming machine 2, a paper web supply section 4, and a paper web reservoir apparatus 6 interposed between the forming machine 2 and the supply section 4.

The supply section 4 includes a pair of web rolls 8 and 10 and a web roll changer 12. In the state shown in FIG. 1, a paper web $P_1$ is paid out from the one web roll 8. The web $P_1$ is fed to a wrapping section 14 of the forming machine 2 via the changer 12 and the reservoir apparatus 6. In FIG. 1, the wrapping section 14 is illustrated only partially.

The leading end of a paper web $P_2$ paid out from the other web roll 10 is previously guided to a predetermined position in the changer 12.

When the paper web $P_1$ of the working roll 8 runs short, the changer 12 first stops the delivery of the web $P_1$ from the working roll 8. In the changer 12 in this state, the leading end of the paper web $P_2$ from the spare roll 10 is connected to the paper web $P_1$, and the web $P_1$ is cut on the upstream side of the junction between the two webs. From this time on, therefore, the paper web $P_2$ from the spare roll 10 can be fed to the wrapping section 14. The changer 12 can make this web roll change automatically.

After passing the reservoir apparatus 6, the paper web $P_1$ is guided to the starting end of the wrapping section 14 through a printing section 16, and thereafter, is run together with a garniture tape G in one direction on the wrapping section 14. The garniture tape G, which is an endless tape circulating through the wrapping section 14, is run at a predetermined speed or line speed by means of a driving roller (not shown). The printing section 16 prints production information for cigarette rod, e.g., plant number and forming machine number, a mark indicative of the cigarette brand, etc. on the paper web $P_1$.

Cut tobacco is continuously fed onto the paper web $P_1$ at the starting end of the wrapping section 14. The following is a brief description of the supply of the cut tobacco.

The cut tobacco ascending in a chimney 18 of the forming machine 2 is attracted in a layer to the lower surface of a suction belt (not shown) of a conveyor system 20. The stratified tobacco, along with the suction belt, is transported toward the wrapping section 14. In this process of transportation, the cut tobacco is trimmed to a layer with a predetermined thickness. When the stratified tobacco reaches the starting end of the wrapping section 14, thereafter, it is dropped from the suction belt onto the paper web $P_1$.

Thus supplied with the cut tobacco, the paper web $P_1$ then wraps the tobacco therein as it travels together with the garniture tape G past the wrapping section 14, in the same manner as in the conventional method, whereby a cigarettes rod is formed in succession. The cigarette rod is delivered from the terminal end of the wrapping section 14 toward a cutting section (not shown). As it passes this cutting section, the cigarette rod is cut into individual cigarettes with a predetermined length.

Figure 2:
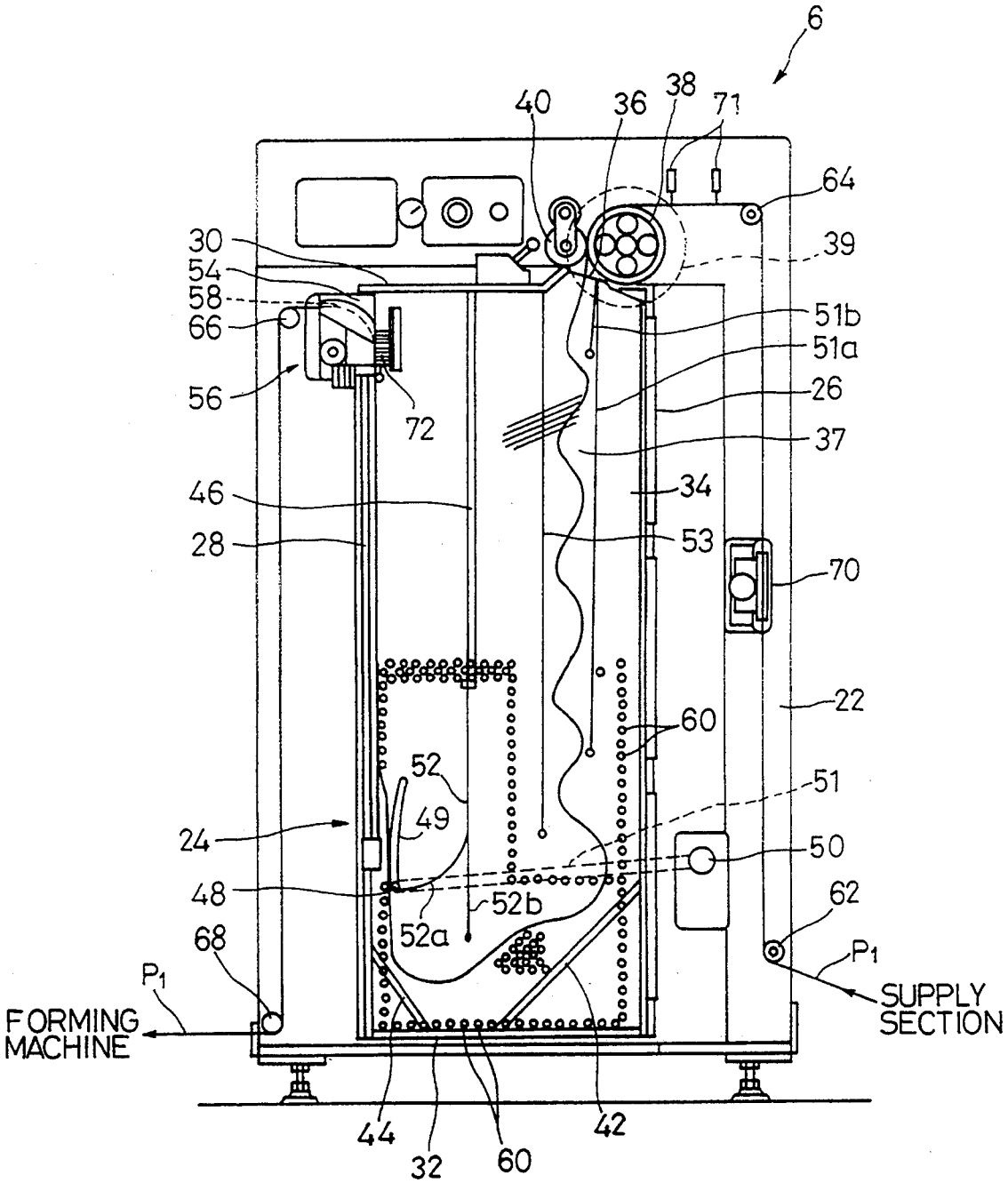
FIG. 2 is an enlarged view of a paper web reservoir apparatus shown in FIG. 1.

As shown in the enlarged view of FIG. 2, the reservoir apparatus 6 is provided with a plate-shaped frame 22, which is set up on the floor. A vertically elongated reservoir box 24 is mounted on the central portion of the frame 22. More specifically, the reservoir box 24 includes a pair of side walls 26 and 28 protruding from the frame 22, top and bottom walls 30 and 32 connecting the top and bottom portions, respectively, of the side walls 26 and 28, and a front wall 34 formed of a transparent resin material. The front wall 34 is openable.

The top wall 30 is formed having an inlet port 36, which is situated on the side of the one side wall 26 or the supply section 4. Outside the reservoir box 24, a feed-in roller 38 is located in the vicinity of the inlet port 36. The roller 38 is rotatably supported on the frame 22. The roller 38 is connected to an electric motor 39, which is indicated by broken line in FIG. 2, and is rotated by the motor 39. The motor 39, which is connected electrically to a controller 41 shown in FIG. 3, can change its rotating speed in response to a control signal from the controller 41.

A pressure roller 40 is in rolling contact with the feed-in roller 38. The roller 40 is also rotatably supported on the frame 22.

A pair of guide plates 42 and 44 are arranged between the bottom wall 32 and both side walls 26 and 28 of the reservoir box 24. These plates 42 and 44 are inclined oppositely to each other so that the bottom portion of the box 24 is reduced in size.

A partition wall 46 is disposed in the reservoir box 24. The wall 46 extends from the top wall 30 toward the bottom wall 32, thereby dividing the upper portion of the inside space of the box 24 on the right and left as illustrated in FIG. 2.

Also, a movable pick-off lever 48 is provided in the reservoir box 24. The lever 48 is situated below the partition wall 46 and on the side of the other side wall 28.

The pick-off lever 48 is in the form of a pin projecting into the reservoir box 24 through an arcuate slot 49 which is formed in the frame 22. Outside the box 24, the lever 48 is supported on the distal end of a connecting arm 51. The arm 51 extends along the rear face of the frame 22, and its proximal end is connected to a support shaft 50. Thus, the pick-off lever 48 can move in the slot 49 along the circular arc round with the support shaft 50, with the aid of the shaft 50 and the arm 51.

In the reservoir box 24, a division sheet 52 hangs down from the lower end of the partition wall 46. The lower part of the sheet 52 is bifurcated. One branch sheet 52*a* of the division sheet 52 is coupled to the pick-off lever 48, and the other branch sheet 52*b* is left free. These branch sheets 52*a* and 52*b* divide the lower portion of the inside space of the box 24 on the right and left as illustrated in FIG. 2.

Figure 3:
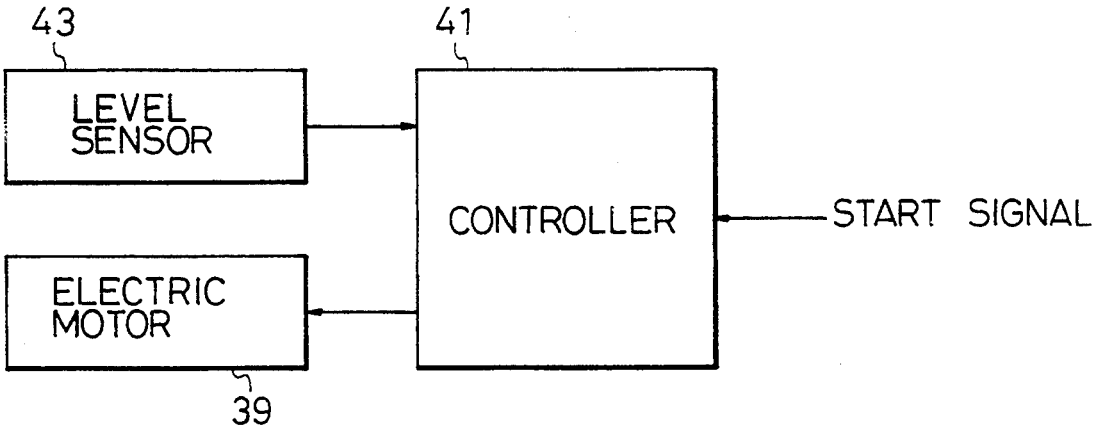
FIG. 3 is a diagram illustrating a control circuit for controlling the rotating speed of a feed roller shown in FIG. 2.

As shown in FIG. 3, the reservoir apparatus 6 is provided with a level sensor 43 for detecting the level position of the pick-off lever 48. The sensor 43, which is connected electrically to the aforesaid controller 41, is composed of an angle sensor for detecting the rotational angle of the support shaft 50, for example. On receiving an angle signal from the angle sensor, the controller 41 can detect the level position of the pick-off lever 48 in accordance with the received signal.

Moreover, division sheets 51*a* and 51*b* are arranged in the reservoir box 24. These sheets 51*a* and 51*b* extended downwardly from the inlet port 36 right under the feed-in roller 38. The one division sheet 51*a* is longer than the other division sheet 51*b*, and its lower end is situated between the respective lower ends of the partition wall 46 and the branch sheet 52*b*. Also, a division sheet 53 extends downwardly from that portion of the top wall 30 which is situated between the partition wall 46 and the division sheet 51*a*. The lower end of the sheet 53 is situated between the respective lower ends of the division sheet 51*a* and the branch sheet 52*b*. The division sheets 51, 52 and 53 are formed of a flexible material, such as antistatic cloth or film.

In the reservoir box 24, the inlet port 36 is connected directly to a storage chamber 37 which is defined between the division sheets 51*a* and 53. Thus, the paper web P, introduced into the reservoir box 24 through the inlet port 36, is confined to the storage chamber 37 by the sheets 51*a* and 53 as it is guided toward the bottom portion of the box 24.

An outlet port 54 is provided at the upper end portion of the side wall 28. The port 54 faces the partition wall 46, and contains a suction brake 56 therein.

The suction brake 56 has a suction guide face 58 for the paper web P. The guide face 58 is an upwardly convex surface, which is formed having a number of suction holes. The suction ports are connected to a suction source (not shown).

The suction brake 56 includes a brush 72, which is mounted in the reservoir box 24 so as to face the starting end of the suction guide face 58.

A number of vent holes 60 are bored through the transparent front wall 34 of the reservoir box 24. Although only some of the vent holes 60 are shown in FIG. 2 for simplicity of illustration, the holes 60 are uniformly distributed mainly in the region below the partition wall 46.

When the paper web $P_1$ paid out from the one paper web roll 8 is delivered to the reservoir apparatus 6, it is then guided to the nip between the feed-in roller 38 and the pressure roller 40 via a pair of guide rollers 62 and 64, lower and upper, as shown in FIG. 2. AS the feed-in roller 38 rotates, the paper web $P_1$ is delivered from the nip between the rollers 38 and 40 into the reservoir box 24, that is, the storage chamber 37, through the inlet port 36. A guide 70 for restraining the paper web P from meandering is provided between the guide rollers 62 and 64, and brushes 71 for removing static electricity from the web P are arranged between the guide roller 64 and the feed-in roller 38.

The paper web $P_1$ fed into the reservoir box 24 through the inlet port 36 first travels through the storage chamber 37 between the division sheets 51*a* and 53 to reach the paired guide plates 42 and 44. After passing under the division sheet 52, guided by the plates 42 and 44, the web $P_1$ travels past the pick-off lever 48 and the suction guide face 58 of the suction brake 56, and is then discharged to the outside of the reservoir box 24 through the outlet port 54. Thereafter, illustrated in FIG. 2 the paper web $P_1$ is fed to the forming machine 2 via a pair of guide rollers 66 and 68, upper and lower.

When the forming machine 2 is in an operating state, the feed-in roller 38 is rotated at a peripheral speed a little lower than the line speed of the paper web on the forming machine side and then feeds the paper web $P_1$ into the reservoir box 24. As the pick-off lever 48 is passed by the web $P_1$, it is lifted to apply a predetermined tension to the web $P_1$, If the peripheral speed of the feed-in roller 38 becomes higher than the line speed by an unallowable value, however, the force from the paper web $P_1$ to press up the pick-off lever 48 is reduced, so that the level position of the lever 48 falls. When this fall is detected by the level sensor 43, the controller 41 reduces the rotating speed or peripheral speed of the feed-in roller 38 in response to a detection signal from the sensor 43. If the peripheral speed of the feed-in roller 38 becomes lower than the line speed by an unallowable value, on the other hand, the force from the paper web $P_1$ to press up the pick-off lever 48 increases, so that the level position of the lever 48 rises. When this rise is detected by the level sensor 43, the controller 41 increases the rotating speed or peripheral speed of the feed-in roller 38 in response to a detection signal from the sensor 43.

By thus controlling the peripheral speed of the feed-in roller 38 in accordance with the level position of the pick-off lever 48, the tension of the paper web $P_1$ can be kept constant.

As the paper web $P_1$ is delivered from the reservoir box 24, moreover, it is attracted to the suction guide face 58 of the suction brake 56. Thus, the web $P_1$ is subjected to a braking force produced by the suction, so that there is no possibility of its slackening on the forming machine side. Since the paper web $P_1$ is securely held between the brush 72 and the suction guide face 58, moreover, it can be prevented from fluttering.

When the remaining web of the working roll 8 in the supply section 4 runs short during the operation of the forming machine 2, the section 4 continuously delivers a start signal for roll changing operation to the controller 41. On receiving this start signal, the controller 41 makes the peripheral speed of the feed-in roller 38 about 10% higher than the line speed on the forming machine side. In this case, the speed of delivery of the paper web $P_1$ from the reservoir box 24 is lower than the speed of introduction of the web $P_1$ into the box 24, so that the web $P_1$ is gradually stored in the box 24. More specifically, the paper web $P_1$ is stored mainly in the storage chamber 37 between the division sheets 51*a* and 53 in a manner such that the paper web $P_1$ is folded.

Even though the paper web $P_1$ is introduced at a high speed, part of an air current produced in the reservoir box 24 by the introduction of the web $P_1$ is discharged through the vent holes 60 in the front wall 34, so that a vortex air current can be prevented from being produced in the box 24. Thus, the paper web $P_1$ can be systematically folded and stored in the reservoir box 24 without being twisted or cut by a vortex air current.

When a given quantity of the paper web $P_1$ is stored in the reservoir box 24, the supply section 4 stops the delivery of the start signal to the controller 41, whereupon the controller 41 stops the rotation of the feed-in roller 38. The supply section 4 stops the delivery of the paper web $P_1$ from the working roll 8, as well as the delivery of the start signal. More specifically, a brake (not shown) for the working roll 8 is applied to stop the rotation of the roll 8.

In this state, the changer 12 of the supply section 4 starts a roll changing operation. Thus, the moment the leading end of the paper web $P_2$ from the spare roll 10 is connected to the paper web $P_1$, the web $P_1$ is cut on the upstream side of the junction between the two webs. When a brake for the spare roll 10 is taken off to make the spare roll 10 rotatable, thereafter, the controller 41 rotates the feed-in roller 38 at the normal speed with the line speed and the roll 10 starts to serve as a working roll. Thus, following the paper web $P_1$, the paper web $P_2$ from the working roll 10 is paid out toward the reservoir apparatus 6.

Even during automatic changing operation for the web roll, the forming machine 2 goes on being supplied with the paper web $P_1$ stored in the reservoir box 24, and its operation is continued.

Since the paper web $P_1$ in the reservoir box 24 is folded in the narrow storage chamber 37 between the division sheets 51*a* and 53, the width of its folds is short. When the paper web $P_1$ is drawn out from the storage chamber 37, therefore, its drawing resistance can be reduced, so that it cannot be twisted or cut.

Further, the branch sheets 52*a* and 52*b* prevent the folded paper web $P_1$ stored in bottom of the box 24 from being pulled up as a lump with delivery of the paper web from the box 24.

Since the outlet port 54 of the reservoir box 24 or the suction brake 56 is situated at the top portion of the box 24, moreover, a long distance can be secured between the pick-off lever 48 and the brake 56. As the paper web $P_1$ from the storage chamber 37 is delivered toward the suction brake 56 via the lever 48, therefore, the folded web $P_1$ is fully straightened.

In the supply section 4, the bare web roll 8 is replaced with a new one, which is to serve as a spare roll.

It is to be understood that the present invention is not limited to the embodiment described above, and that various changes and modifications may be effected therein by one skilled in the art without departing from the scope or spirit of the invention. In the above-described embodiment, for example, the vent holes 60 are formed only in the lower region of the front wall 34 of the reservoir box 24. Alternatively, however, the holes 60 may be distributed over the whole surface of the front wall 34. If necessary, moreover, the vent holes may be also formed in both side walls 26 and 28 and the top wall 30.

What is claimed is:

1. A paper web reservoir apparatus provided along a supply path with a paper web being supplied from a paper web supply section to a paper web consuming unit, said reservoir apparatus comprising:

a reservoir box having an inlet port and an outlet port for the paper web;

said inlet port opening upwardly and said outlet port being located at an upper portion of said reservoir box and opening toward the paper web consuming unit;

said reservoir box including a pair of sheet members for defining a paper web storage chamber, said storage chamber extending downwardly in said reservoir box from the inlet port and being capable of storing the paper web introduced through the inlet port wherein the paper web is folded, said pair of sheet members being formed of a flexible material and extending downwardly from a top wall of said reservoir box; and ventilation means for connecting the inside of said reservoir box to ambient air.

2. The apparatus according to claim 1, wherein said ventilation means includes a plurality of vent holes formed in said reservoir box.

3. The apparatus according to claim 1, and further including feeding means for feeding the paper web, supplied from the supply section, into the storage chamber through the inlet port.

4. The apparatus according to claim 3, wherein said feeding means includes a pair of rollers arranged in the vicinity of the inlet port, for rotation outside said reservoir box, and in rolling contact with each other, and drive means for rotating one of the rollers as a feed-in roller, for passing the paper web between the rollers to be fed into the storage chamber of said reservoir box as the rollers rotate.

5. An apparatus according to claim 4, wherein said feeding means further includes control means for controlling the peripheral speed of the feed-in roller.

6. The apparatus according to claim 5, wherein the supply section includes a pair of web rolls, one of the web rolls serving as a working roll from which the paper web is supplied to the consuming unit, and the other web roll being on standby, and changing means for replacing the working roll with the other roll on standby for the paper web to be supplied to the consuming unit; and the control means increases the peripheral speed of the feed-in roller before the web roll is changed by the changing means.

7. The apparatus according to claim 5, wherein said feeding means further includes detecting means for detecting the tension of the paper web passing in said reservoir box and outputting a detection signal responsive to the variation of the tension, and the control means controls the peripheral speed of the feed-in roller in accordance with the detection signal from the detecting means.

8. The apparatus according to claim 7, wherein the detecting means includes a pin member for guiding the paper web in a traveling motion and a sensor for detecting the level position of the pin member, the pin member being arranged in said reservoir box on the downstream side of the storage chamber with respect to the traveling direction of the paper web and capable of up-and-down motion depending on the tension of the paper web.

9. The apparatus according to claim 5, and further including braking means for braking a traveling motion of the paper web delivered from said reservoir box through the outlet port thereof.

10. The apparatus according to claim 9, wherein the braking means includes a guide located in the outlet port so as to guide the paper web in the traveling motion while attracting the paper web.

11. The apparatus according to claim 10, wherein the braking means further includes a brush for holding the paper web in cooperation with the guide.

* * * * *